US008068082B2

(12) United States Patent
Cho et al.

(10) Patent No.: US 8,068,082 B2
(45) Date of Patent: Nov. 29, 2011

(54) DISPLAY APPARATUS

(75) Inventors: Jae-Hyun Cho, Seoul (KR); Il-Goo Yoon, Asan-si (KR); Chae-Woo Chung, Cheonan-si (KR); Soo-Young Park, Daegu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 546 days.

(21) Appl. No.: 12/331,681

(22) Filed: Dec. 10, 2008

(65) Prior Publication Data

US 2010/0007596 A1 Jan. 14, 2010

(30) Foreign Application Priority Data

Jul. 9, 2008 (KR) ..... 2008-66537

(51) Int. Cl.
*G09G 3/36* (2006.01)

(52) U.S. Cl. ..... 345/98; 349/40

(58) Field of Classification Search ..... None
See application file for complete search history.

(56) References Cited

U.S. PATENT DOCUMENTS

| | | | | |
|---|---|---|---|---|
| 7,477,332 | B2 * | 1/2009 | Park et al. | 349/40 |
| 2007/0171215 | A1 * | 7/2007 | Song | 345/204 |
| 2008/0143702 | A1 * | 6/2008 | Park | 345/211 |

* cited by examiner

*Primary Examiner* — Paul Huber
(74) *Attorney, Agent, or Firm* — F. Chau & Associates, LLC

(57) ABSTRACT

A display apparatus includes a display panel that displays an image in response to a data voltage, a data driving unit that outputs the data voltage in response to a driving signal, and a printed circuit board that outputs the driving signal and that has a static electricity discharge circuit. The discharge circuit discharges high-voltage static electricity, which is introduced into the data driving unit, to ground. Accordingly, the display apparatus prevents the data driving unit from being damaged by the high-voltage static electricity.

10 Claims, 4 Drawing Sheets

DISPLAY APPARATUS

CROSS-REFERENCE TO RELATED APPLICATION

This application relies for priority upon Korean Patent Application No. 2008-66537 filed on Jul. 9, 2008, the contents of which are herein incorporated by reference in their entirety.

BACKGROUND

1. Technical Field

The present disclosure relates to a display apparatus. More particularly, the present disclosure relates to a display apparatus capable of protecting internal driving chips from high-voltage static electricity 2. Discussion of Related Art Recently, liquid crystal displays (LCDs) have been extensively used due to their inherent advantages such as slimness, light weight and low power consumption. The LCD includes a controller that generates and outputs control signals, a data driving chip that outputs data signals in response to the control signals, and a liquid crystal display panel that displays images in response to the data signals.

The data driving chip is electrically connected to one end of the liquid crystal display panel and constitutes a panel module together with the liquid crystal display panel. The panel module is entirely shielded by a case typically formed of metal, except for the front surface of the liquid crystal display panel that displays the images.

Unlike the case, however, the liquid crystal display panel includes nonmetallic material, so static electricity is induced to the liquid crystal display panel. Such static electricity is introduced into the data driving chip attached to the liquid crystal display panel, causing damage to the data driving chip. In addition, the static electricity applied to the data driving chip is introduced into the controller that is electrically connected to the data driving chip, so that other internal circuit devices of the controllers are also damaged by the static electricity.

SUMMARY

Therefore, an exemplary embodiment of the present invention provides a display apparatus capable of protecting internal circuit devices from damages due to static electricity.

In an exemplary embodiment of the present invention, a display apparatus includes a display panel module that displays an image and a receptacle that receives the display panel module.

The display panel module includes a display panel, a data driving unit, a gate driving unit, and a printed circuit board. The display panel displays the image in response to a data voltage and a gate voltage. The data driving unit receives first and second driving signals and outputs the data voltage in response to the first driving signal. The gate driving unit receives the second driving signal from the data driving unit and outputs the gate voltage in response to the second driving signal. The printed circuit board includes a discharge circuit that outputs the first and second driving signals to the data driving unit and discharges static electricity introduced into the data driving unit toward the receptacle that receives the display module.

According to the display apparatus of the exemplary embodiment, the discharge circuit is provided on the printed circuit board to discharge high-voltage static electricity, which is introduced into the data driving unit, toward a receptacle housing a display panel module. Because the high-voltage static electricity is discharged toward the receptacle, the data driving unit can be protected from damage caused by the high-voltage static electricity.

BRIEF DESCRIPTION OF THE DRAWINGS

Exemplary embodiments of the present invention will be understood in more detail from the following descriptions taken in conjunction with the accompanying drawings, wherein.

DESCRIPTION OF THE EXEMPLARY EMBODIMENTS

Hereinafter, exemplary embodiments of the present invention will be explained in detail with reference to the accompanying drawings.

Figure 1:
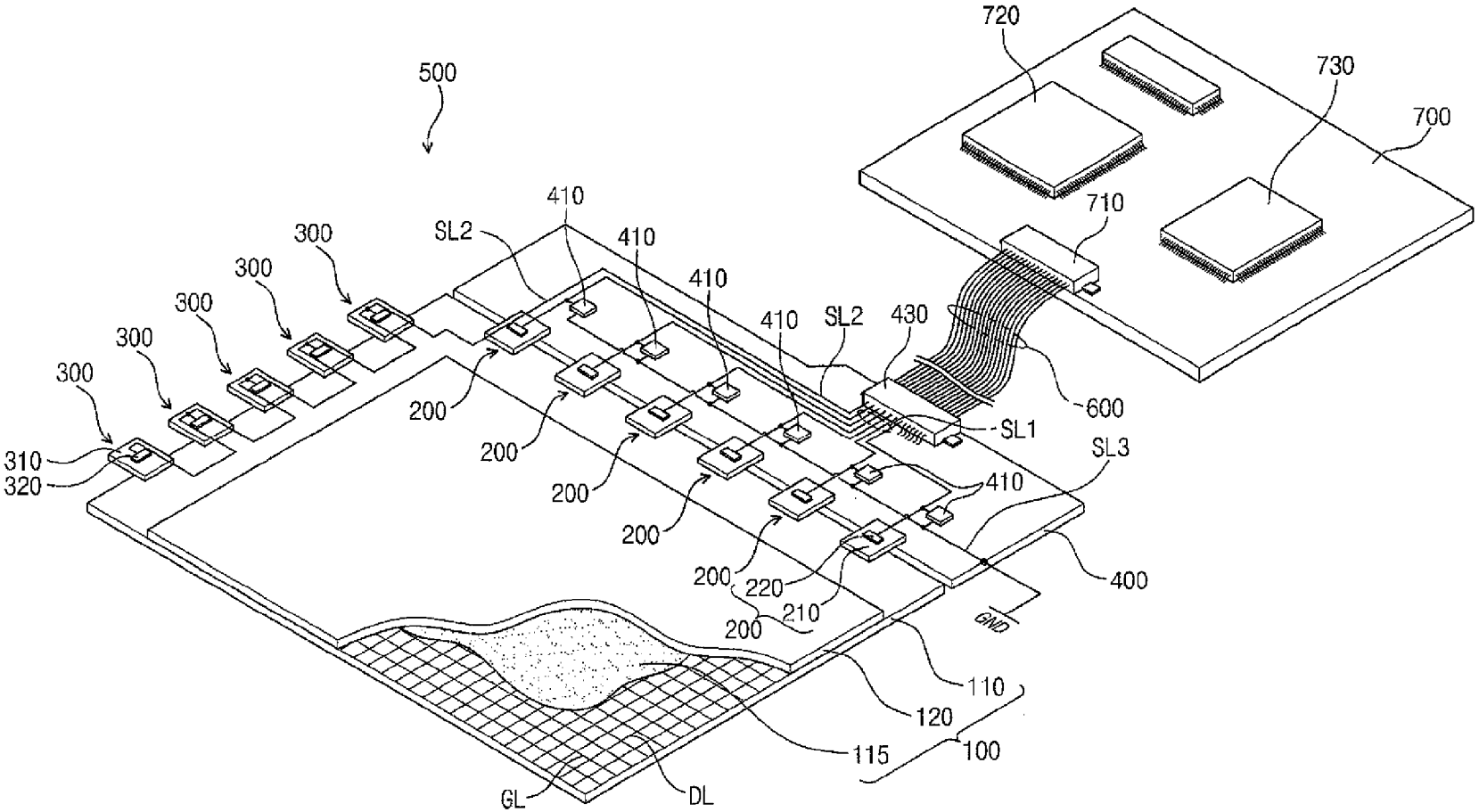
FIG. 1 is a perspective view showing an exemplary embodiment of a display panel module according to the present invention.
Figure 2:
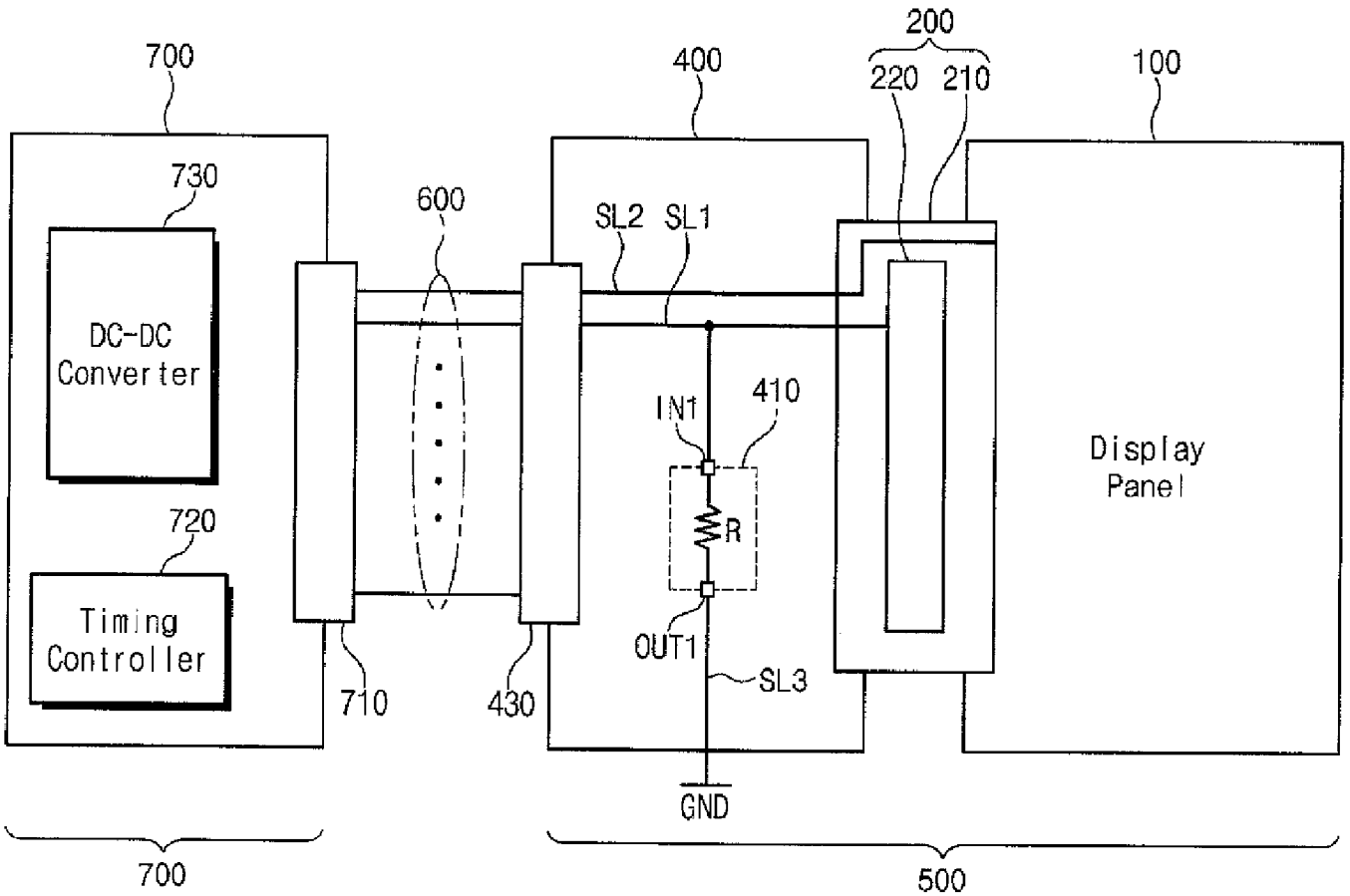
FIG. 2 is a view showing an exemplary embodiment of a discharge circuit illustrated in FIG. 1.

FIG. 1 is a perspective view showing an exemplary embodiment of a display panel module 500 according to the present invention, and FIG. 2 is a view showing an exemplary embodiment of a discharge circuit illustrated in FIG. 1. In FIG. 1, a control printed circuit board 700, hereinafter, referred to as a control board, which is electrically connected to the display panel module 500, is shown together with the display panel module 500. In addition, data driving units 200 including six data driving chips 220, respectively, are shown in FIG. 1. Thus, six interconnections are provided to transfer an analog supply voltage, which is supplied from the control board 700, to the six data driving chips 220. As shown in FIG. 1, six discharge circuits 410 are provided to electrically connect six first driving interconnections SL1, respectively, to a single third driving interconnection SL3. In order to facilitate explanation, one first driving interconnection SL1, one data driving chip 220 and one base film 210, on which the data driving chip 220 is mounted, are shown in FIG. 2 as an example.

Referring to FIGS. 1 and 2, the display panel module 500 receives image signals, control signals, and driving signals including a driving voltage from the control board 700. The control board 700 is electrically connected to the display panel module 500. That is, an electrical connector 710 of the control board 700 is electrically connected to an electrical connector 430 of the display panel module 500 through a plurality of signal lines 600. A timing controller 720 and a DC-DC converter 730 are provided on the control board 700. The timing controller 720 generates and outputs the image signals and control signals to the display panel module 500. The DC-DC converter 730 receives a supply voltage from an external device (not shown) to generate and output the driving voltage used to drive the display panel module 500. The driving voltage includes a digital driving voltage and an analog supply voltage. The digital driving voltage and analog supply voltage are applied to the data driving units 200 provided in the display panel module 500. The digital driving voltage is used to drive an internal logic (not shown) of the data driving units 200. The analog supply voltage serves as a reference voltage to generate a data voltage that is output from the data driving units 200. That is, the data driving units 200 output a gray scale voltage, which corresponds to the image signal, as the data voltage for the pixels. The gray scale voltage is one of a plurality of gray scale voltages that are generated by dividing a potential difference between the analog supply voltage and a ground voltage.

Hereinafter, the display panel module 500 will be described in detail.

The display panel module 500 includes the discharge circuits 410 capable of rapidly discharging static electricity applied to the data driving units 200 from the outside. By action of the discharge circuits 410, the data driving circuits 200 can be protected from damage caused by the static electricity. In addition, the static electricity applied to the data driving units 200 can be prevented from being transferred to the control board 700 through the signal lines 600. Thus, circuit devices provided on the control board 700 can be prevented from being damaged by the static electricity. To this end, the display panel module 500 includes a display panel 100, the data driving units 200, the gate driving units 300, and a data printed circuit board 400, hereinafter referred to as a data board, on which the discharge circuits 410 are provided.

The display panel 100 displays images in response to the data voltage and gate voltage. In the present exemplary embodiment, the liquid crystal display panel will be described as an example of the display panel, however, the present invention is not limited thereto.

The liquid crystal display panel 100 includes an array substrate 110, an opposite substrate 120 facing the array substrate 110, and a liquid crystal layer 115 interposed between the array substrate 110 and the opposite substrate 120. A plurality of data lines DL receiving the data voltage from the data driving units 200 and a plurality of gate lines GL receiving the gate voltage from the gate driving units 300 are aligned on the array substrate 110. The data lines DL cross the gate lines GL while being insulated from the gate lines GL. A plurality of pixel areas are defined by the data lines DL and the gate lines GL. A thin film transistor (not shown) and a pixel electrode (not shown) electrically connected to the thin film transistor are provided in each pixel area of the liquid crystal display panel 100. The thin film transistor is electrically connected to the corresponding gate line GL and data line DL to apply the data voltage to the pixel electrode in response to the gate voltage that is input through the corresponding gate line GL. The opposite substrate 120 is provided thereon with a color filter (not shown) and a common electrode (not shown). The color filter is provided in a display area of the array substrate 110, that is, the color filter is provided corresponding to the pixel area. The common electrode faces the pixel electrode while interposing the liquid crystal layer 115 therebetween. A liquid crystal capacitor (not shown) is defined by the common electrode, the liquid crystal layer 115 and the pixel electrode.

The data driving units 200 receive first and second driving signals from the data board 400 and output the data voltage to the liquid crystal display panel 100 by using the first driving signal, hereinafter referred to as an analog supply voltage. Each data driving unit 200 includes a first base film 210, and a data driving chip 220 mounted on the first base film 210. For instance, each data driving chip 220 can be mounted on each base film 210 through a chip-on-film method (COF). One end of the first base film 210 is electrically attached to a peripheral area of the liquid crystal display panel 100. Each data driving chip 220 mounted on the first base film 210 is electrically connected to the corresponding data line DL through an interconnection (not shown) formed on the first base film 210.

The data driving chips 220 receive the analog supply voltage of about 15 volts from the data board 400 to generate the data voltage. Because the digital driving voltage used to drive the internal logic of the data driving chips 200 is about 3.3V, the analog supply voltage (15V) used to generate the data voltage is relatively high. Therefore, in order to prevent an abnormal analog supply voltage that exceeds 15V, an overvoltage protection circuit (not shown) is provided in the data driving chips 220.

As described above in relation to problems in the related art, if high-voltage static electricity of about 15 kV is applied through the liquid crystal display panel 100, the data driving chips 220 are primarily damaged. More specifically, the overvoltage protection circuit provided in the data driving chips 220 is damaged. That is, the static electricity is applied to input/output terminals of the analog supply voltage through the surface of the data driving chips 220, so that the overvoltage protection circuit connected to the input/output terminals of the analog supply voltage is damaged. Further, the static electricity causes physical damage to the first base films 210 on which the data driving chips 220 are mounted. Accordingly, in the present exemplary embodiment, the discharge circuits 410 are provided on the data board 400, which is electrically connected to the other end of the first base films 210 constituting the data driving units 200, in order to discharge the static electricity More specifically, because the discharge circuits 410 are provided on the data board 400 directly connected to the data driving units 200, the static electricity may be rapidly discharged. The discharge circuits 410 will be described hereinbelow in detail when explaining the data board 400.

Each gate driving unit 300 shown in FIG. 1 includes a second base film 310, and a gate driving chip 320 mounted on the second base film 310. As described above, each gate driving chip 320 can be mounted on each base film 310 through the COF method, or electrically connected to the liquid crystal display panel 100 through a tape carrier package (TCP) method. The gate driving units 300 receive the second driving signal, hereinafter referred to as a gate signal, through one of the base films 210 of the data driving unit 200, which is closely adjacent the gate driving units 300.

The data board 400 receives the analog supply voltage (the first driving signal) and the gate signal (the second driving signal) from the control board 700 and then outputs the analog supply voltage and the gate signal to the data driving unit 200. In addition, the data board 400 discharges the static electricity that is introduced to the data driving unit 200 through the liquid crystal display panel 100. In more detail, the data board 400 includes first driving interconnections SL1, hereinafter referred to as an analog supply power interconnection, a second driving interconnection SL2, hereinafter referred to as a gate signal interconnection, to transmit the gate signal, a third driving interconnection SL3 hereinafter referred to as a discharge interconnection, to guide the static electricity to the ground GND, and discharge circuits 410 to transmit the static electricity, which is transferred to the analog supply voltage interconnections SL1 through the data driving unit 200, to the discharge interconnection SL3. In the present exemplary embodiment, six discharge circuits 410 are provided to electrically connect six analog supply voltage interconnections SL1 to one discharge interconnection SL3.

Referring to FIG. 2, each discharge circuit 410 includes a resistor R having a first terminal connected to a first input terminal IN1 and a second terminal connected to a first output terminal OUT1. Thus, when the high-voltage static electricity is introduced into the data driving unit 200, the high-voltage static electricity is rapidly discharged to the ground GND through the resistor R. As a result, the data driving unit 200 can be protected from damage caused by the static electricity, and the static electricity can not be introduced into the control board 700, so that circuit devices formed on the control board 700 can be protected from the static electricity.

The resistor R may be a fixed resistor having a fixed resistance value or a variable resistor having a variable resistance value. Recently, the liquid crystal display is fabricated in a small size, so the size of the data board 400 has become gradually reduced. Thus, when taking the size of the data board 400 into consideration, the fixed resistor is preferable because the fixed resistor enables a circuit configuration in a relatively narrow area. The resistance value of the resistor R can be variously set by a system designer. If the resistance value of the resistor R is excessively low, however, leakage current may occur through the resistor R. In this case, an abnormal analog supply voltage, for instance, a voltage much less than 15V is applied to the data driving unit 200 through the analog supply voltage interconnection, so that the data driving unit 200 outputs the abnormal data voltage. In contrast thereto, if the resistance value of the resistor R is excessively high, the static electricity will not be discharged through the resistor R. Therefore, a resistor R having an excessively high resistance value may not provide a normal discharge path. In this regard, the resistance value must be set with serious consideration. For example, the resistor R may have a resistance value in the range of about 100MΩ to about 300MΩ.

Figure 3:
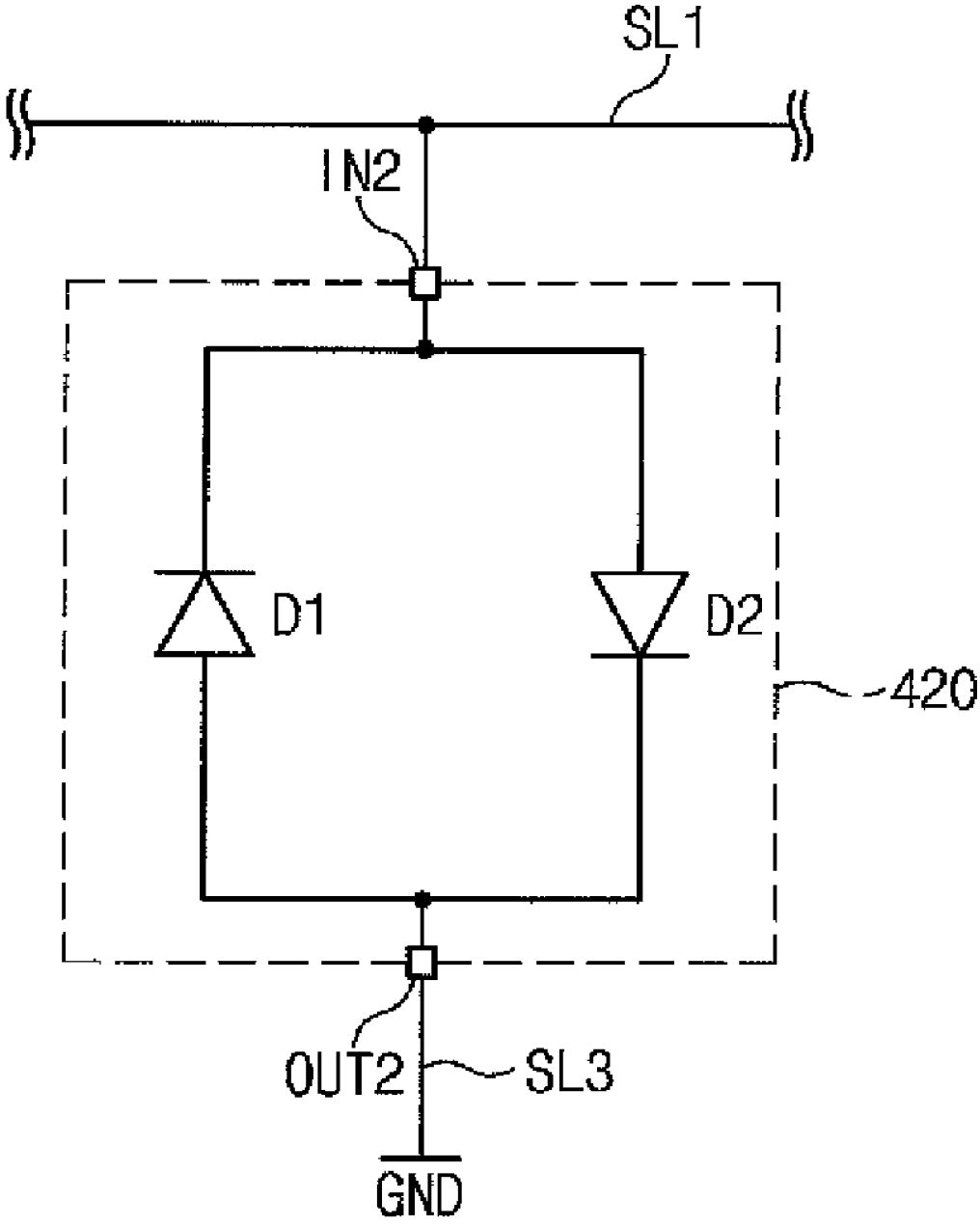
FIG. 3 is a view showing an exemplary embodiment of a discharge circuit according to the present invention.

FIG. 3 is a circuit diagram of an exemplary embodiment of a discharge circuit 420 according to the present invention.

Referring to FIG. 3, the discharge circuit 420 according to another exemplary embodiment of the present invention includes a second input terminal IN2 connected to the analog supply voltage interconnection SL1, a second output terminal OUT2 connected to the discharge interconnection SL3 that is connected to ground, and first and second diodes D1 and D2 connected in parallel with opposite polarities between the second input terminal IN2 and the second output terminal OUT2. More specifically, an anode of the first diode D1 is electrically connected to the ground GND through the second output terminal OUT2, and a cathode of the first diode D1 is electrically connected to the analog supply voltage interconnection SL1 through the second input terminal IN2. In addition, an anode of the second diode D2 is electrically connected to the analog supply voltage interconnection SL1 through the second input terminal IN2, and a cathode of the second diode D2 is electrically connected to the ground GND through the second output terminal OUT2.

If a normal analog supply voltage, which is lower than a threshold voltage of the second diode D2, is applied to the analog supply voltage interconnection SL1, the second diode D2 is turned off. Thus, the analog supply voltage interconnection SL1 and the discharge interconnection SL3 are electrically open. In contrast, if static electricity having a high-voltage, which is higher than the threshold voltage of the second diode D2, is applied to the analog supply voltage interconnection SL1, the second diode D2 is turned on. Thus, the analog supply voltage interconnection SL1 and the discharge interconnection SL3 are electrically shorted, so that the high-voltage static electricity is discharged to the ground GND through the discharge interconnection SL3. Therefore, the high-voltage static electricity introduced into the data driving unit 200 is rapidly discharged to the ground GND. In addition, the high-voltage static electricity may not be introduced into the control board 700, so that circuit devices formed on the control board 700 can be prevented from being damaged.

Figure 4:
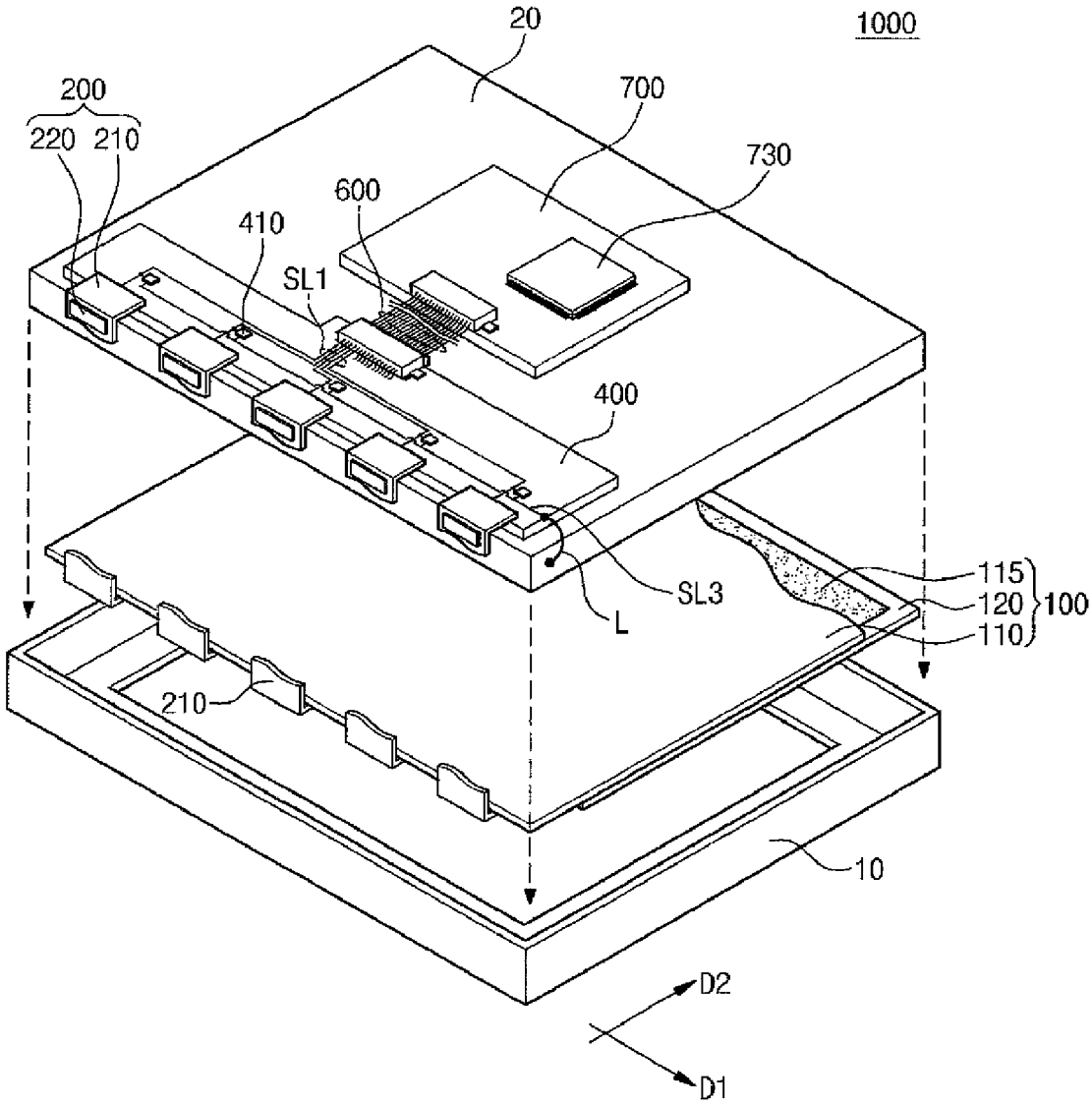
FIG. 4 is an exploded perspective view showing an exemplary embodiment of a display apparatus according to the present invention.

FIG. 4 is an exploded perspective view showing an exemplary embodiment of a display apparatus according to the present invention.

Although FIG. 4 shows a liquid crystal display 1000 as an example of various display apparatuses, the present invention is not limited thereto. Exemplary embodiments of the present invention are applicable for other display apparatuses, such as a plasma display panel (PDP) and an organic light emitting diode (OLED), in addition to the liquid crystal display 1000. In the following description, the same reference numerals as used above will be used to refer to the same elements and detailed description thereof will be omitted in order to avoid redundancy. Unlike the data driving unit 200 shown in FIG. 1, in which the data driving unit 200 includes six base films 210 and six data driving chips 220 mounted on the six base films 210, respectively, the data driving unit 200 shown in FIG. 4 includes five base films 210 and five data driving chips 220 mounted on the five base firms 210, respectively. In addition, the gate driving unit 300 shown in FIG. 1 is omitted for simplicity in the showing of FIG. 4.

Referring to FIG. 4, the liquid crystal display 1000 includes the display panel module 100, which has been described with reference to FIGS. 1 to 3, and a receptacle 20 that receives the display panel module. In addition, the liquid crystal display 1000 further includes a chassis 10.

The display panel module includes discharge circuits 410 provided on the data board 400. The data board 400 having the discharge circuits 410 is accommodated in the receptacle 20.

The receptacle 20 includes a material having high strength, such as metal, for example, aluminum. The data board 400 is connected to bent base films 210 and is fixed to a rear surface of the receptacle 20. The receptacle 20 is electrically connected to the discharge interconnection SL3 provided on the data board 400, so that the receptacle 20 may serve as the ground GND. Thus, the high-voltage static electricity introduced into the data driving unit 200 is discharged to the surface of the receptacle 20, which serves as the ground GND, by way of the analog supply voltage interconnection SL1, the discharge circuits 410, and the discharge interconnection SL3 provided on the data board 400. Although FIG. 4 shows the discharge interconnection SL3 connected to one side of the receptacle 20 through a predetermined interconnection L, the discharge interconnection SL3 can be connected to the other side or the rear side of the receptacle 20.

The chassis 10 presses a peripheral portion of the liquid crystal display panel 100 of the display panel module and is fixed to the receptacle 20. Thus, the chassis 10 prevents the liquid crystal display panel 100 from becoming separated.

In other words, the high-voltage static electricity introduced into the data driving unit 200 may be rapidly discharged to the surface of the receptacle 20 through the discharge circuits 410 provided on the data board 400. As a result, the data driving unit 200 may be protected from damage caused by the high-voltage static electricity, and the high-voltage static electricity is prevented from being introduced into the control board 700 through the data board 400, so that the circuit devices provided on the control board 700 are also prevented from being damaged.

Meanwhile, although not shown in FIGS. 1 to 4, a backlight assembly including a reflective plate (not shown), a light guide plate (not shown), a lamp (not shown) and optical sheets (not shown) can be provided between the liquid crystal display panel 100 and the receptacle 20. In that case, the backlight assembly is accommodated in the receptacle 20 together with the liquid crystal display panel 100.

Although exemplary embodiments of the present invention have been described, it is understood that the present invention should not be limited to these exemplary embodiments but various changes and modifications can be made by one of ordinary skill in the art within the spirit and scope of the present invention, as hereinafter claimed.

What is claimed is:

1. A display apparatus comprising:

a display panel module that displays an image; and a receptacle that receives the display panel module, wherein the display panel module comprises:

a display panel that displays the image in response to a data voltage and a gate voltage;

a data driving unit that receives first and second driving signals and outputs the data voltage in response to the first driving signal;

a gate driving unit that receives the second driving signal from the data driving unit and outputs the gate voltage in response to the second driving signal; and a printed circuit board comprising a discharge circuit that outputs the first and second driving signals to the data driving unit and discharges static electricity introduced into the data driving unit to the receptacle.

2. The display apparatus of claim 1, wherein the data driving unit comprises:

abase film; and a driving chip mounted on the base film.

3. The display apparatus of claim 2, wherein the printed circuit board comprises:

a first driving interconnection transferring the first driving signal to the driving chip; and a second driving interconnection transferring the second driving signal to the gate driving unit through the base film, wherein the discharge circuit electrically connects the first driving interconnection to a ground.

4. The display apparatus of claim 3, wherein the static electricity introduced into the data driving unit is discharged to the receptacle through the first driving interconnection and the discharge circuit.

5. The display apparatus of claim 4, wherein the receptacle serves as a ground.

6. The display apparatus of claim 5, wherein the data voltage is one of a plurality of gray voltages generated by dividing a potential difference between an analog supply voltage and a ground voltage, and the first driving signal serves as the analog supply voltage.

7. The display apparatus of claim 6, wherein the discharge circuit comprises a resistor having a first terminal connected to the first driving interconnection and a second terminal connected to the receptacle.

8. The display apparatus of claim 7, wherein the resistor comprises one of a fixed resistor having a fixed resistance value and a variable resistor having a variable resistance value.

9. The display apparatus of claim 5, wherein the discharge circuit comprises first and second diodes connected in parallel between the first driving interconnection and the receptacle, the first diode comprises an anode terminal electrically connected to the first driving interconnection and a cathode terminal connected to the ground, and the second diode comprises a cathode terminal electrically connected to the first driving interconnection and an anode terminal connected to the ground.

10. The display apparatus of claim 5, wherein the printed circuit board further comprises a discharge interconnection electrically connecting the discharge circuit to the receptacle.

* * * * *